US008985123B2

(12) United States Patent
Green

(10) Patent No.: US 8,985,123 B2
(45) Date of Patent: Mar. 24, 2015

(54) CAP FOR BRUSHING HAIR INTO A WRAP STYLE

(71) Applicant: Amber A. Green, Stone Mountain, GA (US)

(72) Inventor: Amber A. Green, Stone Mountain, GA (US)

(73) Assignee: Amber A. Green, Atlanta, GA (US)

( * ) Notice: Subject to any disclaimer, the term of this patent is extended or adjusted under 35 U.S.C. 154(b) by 13 days.

(21) Appl. No.: 13/769,994

(22) Filed: Feb. 19, 2013

(65) Prior Publication Data

US 2014/0230836 A1 Aug. 21, 2014

(51) Int. Cl.

| | |
|---|---|
| ***A45D 24/10*** | (2006.01) |
| ***A45D 7/02*** | (2006.01) |
| ***A45D 24/12*** | (2006.01) |
| ***A45D 8/40*** | (2006.01) |
| ***A45D 2/00*** | (2006.01) |
| ***A42B 1/24*** | (2006.01) |
| ***A46B 9/02*** | (2006.01) |
| ***A45D 2/46*** | (2006.01) |
| ***A42B 1/04*** | (2006.01) |

(52) U.S. Cl.

CPC . *A46B 9/023* (2013.01); *A45D 2/46* (2013.01); *A45D 2/00* (2013.01); *A42B 1/041* (2013.01); *A45D 8/40* (2013.01)

USPC ..... 132/148; 132/212; 132/130; 132/274; 132/223; 2/209.13

(58) Field of Classification Search

CPC ..... A45D 2/00; A45D 2/46; A45D 2002/003; A45D 2002/005; A45D 2002/006; A45D 2002/007; A45D 8/40; A45D 1/041; A45D 1/24; A45D 1/004; A45D 24/10; A42B 1/041; A42B 1/24; A42B 1/004; A46B 9/023

USPC ..... 132/148, 210, 212, 213.1, 219, 120, 132/130, 149, 150, 274, 275, 54, 55, 333, 132/200, 60, 63.1, 223, 226, 144, 243, 132/279–284, 273, 57.1, 61, 58, 59, 64.1, 132/65.1, 66.1, 68.1, 71.1, 72.1; 2/410, 6.2, 2/422, 10, 171, 171.2, 202, 209.13, 2/204.14, 209.5, 175.3, 175.5, 174, 204, 2/DIG. 11, 68, 171.8, 173.5, 182.6, 2/182.7, 209.14, 271.02, 209.3, 171.02; D2/865, 866, 867, 873, 874, 877, 881, D2/894, 895, 891, 892; 4/516–518

See application file for complete search history.

(56) References Cited

U.S. PATENT DOCUMENTS

| | | | | | |
|---|---|---|---|---|---|
| 954,776 | A | * | 4/1910 | Brownstein | 132/65.1 |
| 985,488 | A | * | 2/1911 | Wright | 2/209.7 |
| 1,002,060 | A | * | 8/1911 | Hill | 2/174 |
| 1,017,372 | A | * | 2/1912 | Belasco | 132/63.1 |
| 1,030,906 | A | * | 7/1912 | Mandak | 132/68.1 |
| 1,056,083 | A | * | 3/1913 | Zetka | 132/66.1 |
| 1,095,752 | A | * | 5/1914 | Ulrich | 132/57.1 |
| 1,328,771 | A | * | 1/1920 | Strahan | 132/223 |

(Continued)

*Primary Examiner* — Vanitha Elgart

(57) ABSTRACT

A cap which wraps hair and protects it from tangling during sleep or other activity. The cap contains an outer layer, one or more rows of bristles of relatively resilient material for wrapping hair and at least one handle. The one or more rows of bristles of relatively resilient material brushes a wearer's hair in either a clockwise or counter-clockwise direction to pull the hair up into the hat in an organized manner. The one or more rows of bristles of relatively resilient material for wrapping hair may also be used to reverse the process and let hair down in an organized style.

10 Claims, 4 Drawing Sheets

(56) References Cited

U.S. PATENT DOCUMENTS

| | | | | | |
|---|---|---|---|---|---|
| 1,460,653 | A | * | 7/1923 | Higgins | 132/118 |
| 1,514,495 | A | * | 11/1924 | Wirth | 34/101 |
| 1,523,979 | A | * | 1/1925 | Ryan et al. | 601/137 |
| 1,997,063 | A | * | 4/1935 | Hughes | 2/174 |
| 2,005,465 | A | * | 6/1935 | Janda | 132/223 |
| 2,134,878 | A | * | 11/1938 | La Fortune | 132/128 |
| 2,507,386 | A | * | 5/1950 | Spiegel | 132/212 |
| 2,510,554 | A | * | 6/1950 | Christie | 132/101 |
| 2,617,433 | A | * | 11/1952 | Carney | 132/130 |
| 2,711,745 | A | * | 6/1955 | Hill | 132/60 |
| 2,994,556 | A | * | 8/1961 | Sewelin et al. | 296/57.1 |
| 3,051,960 | A | * | 9/1962 | Rendulich | 2/68 |
| 3,373,739 | A | * | 3/1968 | Rankin | 601/114 |
| 3,392,737 | A | * | 7/1968 | Fefferman | 132/274 |
| 3,505,683 | A | * | 4/1970 | Wright | 2/204 |
| 3,522,813 | A | * | 8/1970 | Corey | 132/274 |
| 3,672,376 | A | * | 6/1972 | Parlagreco | 132/212 |
| 3,908,673 | A | * | 9/1975 | Carr | 132/223 |
| 3,929,143 | A | * | 12/1975 | Coleman | 2/171.2 |
| 3,983,580 | A | * | 10/1976 | Zeiber | 2/174 |
| 4,078,557 | A | * | 3/1978 | Spencer | 601/114 |
| 4,215,709 | A | * | 8/1980 | Carr | 132/207 |
| 4,361,158 | A | * | 11/1982 | Baker | 132/212 |
| 4,951,320 | A | * | 8/1990 | Yoon | 2/181.2 |
| 5,490,528 | A | * | 2/1996 | Day | 132/200 |
| 5,572,746 | A | * | 11/1996 | Linico | 2/182.1 |
| 5,708,982 | A | * | 1/1998 | Armani | 2/171 |
| 5,727,575 | A | * | 3/1998 | Rontal | 132/200 |
| 5,787,507 | A | * | 8/1998 | Sullivan | 2/182.1 |
| 6,076,191 | A | * | 6/2000 | Kapas | 2/171.02 |
| 6,481,020 | B1 | * | 11/2002 | Kirkland | 2/174 |

* cited by examiner

CAP FOR BRUSHING HAIR INTO A WRAP STYLE

FIELD OF THE INVENTION

This invention relates generally to cap, and more specifically, to a cap fitted to the head with brush bristles inside the cap which brush hair into a circular wrap style.

BACKGROUND OF THE INVENTION

A person's hair is a very important attribute. Men and women world-wide spend billions of dollars a year on hair care, products, and services. In addition to these products and services, consumers look to maintain hair styles for maximum look with minimum effort. One such way, in the case of medium to long straight hair, is to "wrap" ones hair. Wrapping your hair occurs when you brush your hair in a circular motion around your head so as to get your hair to lie tightly around your head. The hair can then be pinned in place and tied with a night scarf or cap or it can be covered without the use of pins. Once hair has been wrapped, it can be maintained in a "ready to wear" style that protects against the elements or from being disheveled while one sleeps or travels or wears a winter hat. However, the process of wrapping one's hair can be very difficult, as hair has a tendency to fall from the head while one attempts to brush one's hair into a circular position on the head. Furthermore, hair has a tendency to move while attempting to place a scarf or cap over the hair. The use of pins or clips helps this process, but they tend to be uncomfortable when worn for prolonged periods of time. The present invention attempts to solve the foregoing problems.

SUMMARY OF THE INVENTION

This invention is an improvement over the known methods.

In one aspect, the invention relates to a cap for the efficient wrapping of hair. The cap includes an outer layer, one or more handles, and means for wrapping hair. The means for wrapping hair may be attached directly to the outer layer on the inside of the outer layer. The cap may also include both an outer layer and an inner layer and the means for wrapping hair may be attached directly to the inner layer.

DETAILED DESCRIPTION OF THE PREFERRED EMBODIMENTS

Figure 1:
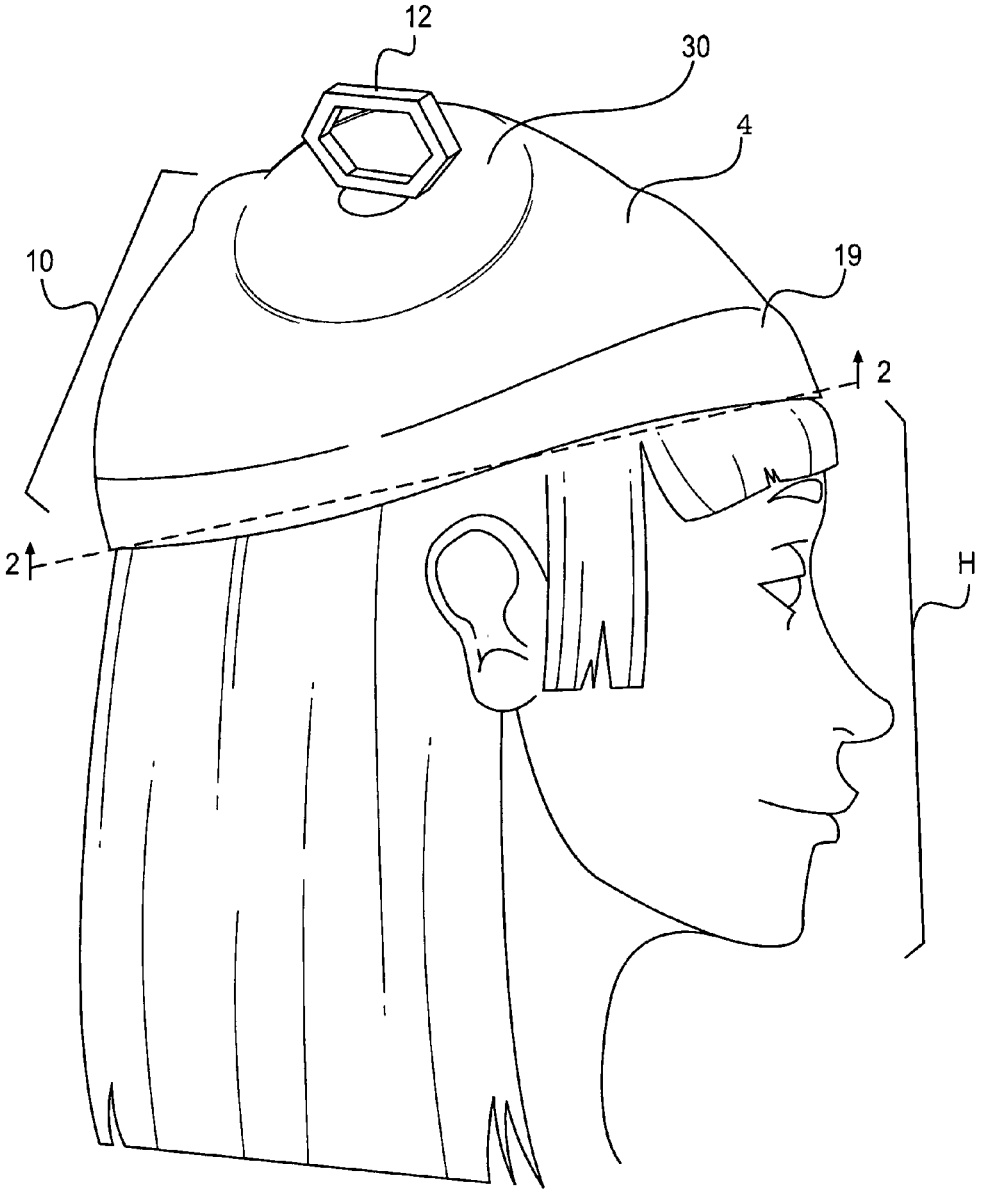
FIG. 1 is a side view of a preferred embodiment of the invention shown pulled over a head.
Figure 2:
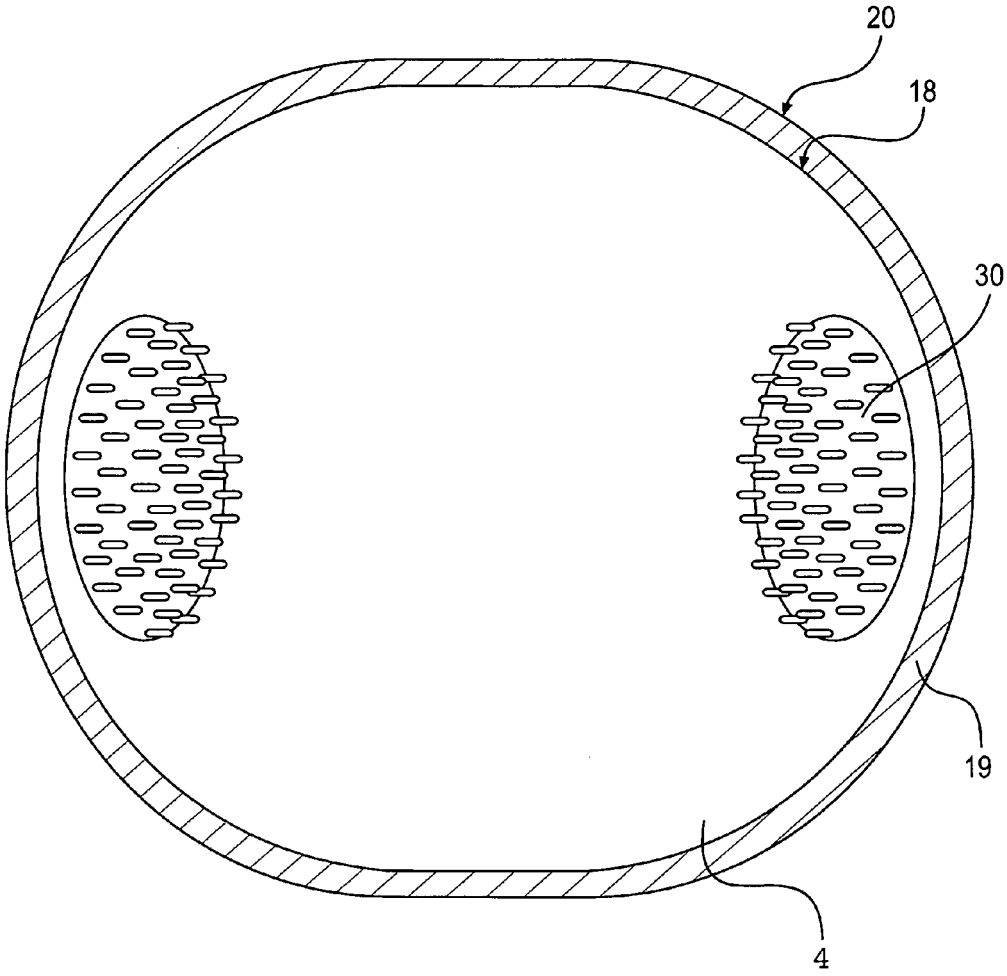
FIG. 2 is a cut away view of the preferred embodiment taken along line 2-2 of FIG. 1.

The following are non-limiting examples of preferred implementations of this invention.

Referring to FIGS. 1-4, there are shown preferred embodiments of the invention, generally indicated by the reference numeral 10. The cap 10 is shown in FIGS. 1-4 as pulled over a human head H in a conventional manner.

As is conventional, the cap 10 has a covering portion 4, which covers the head of a wearer, and a band 19, which extends around the head of a wearer around the forehead region and around to the nape of the neck.

However, the cap 10 of the present invention may be any of a stocking cap, a casual cap, a sport cap, a dress cap, silk cap, pantyhose cap, scarf cap or any other head covering now known or that may be conceived which is worn to protect hair.

The cap 10 of the present invention is not limited by dimensions such as length, width, height, or depth and can be of various thicknesses at any portion. The cap 10 of the present invention is also suitable for men, women, and/or children. The foregoing allows the cap 10 to be used during numerous circumstances, for all seasons, in varying climates, with any type of headwear, solely as headwear, or by individuals with varying amounts of hair. The cap 10 can be made adjustable to accommodate more or less hair or different hair textures, thicknesses, or coarseness.

The cap 10 of the present invention may also serve as headwear by having, for example, patterns or shapes that are aesthetically pleasing. The cap 10 may serve as a form of cover for the wearer in all types of climates and may therefore be thicker or lighter, depending on the wearer's preference.

The cap 10 has an outer layer 20. The outer layer 20 of the present invention is not limited by material. The material of the outer layer 20 of the present invention may be any material naturally occurring or synthetic now known or that may be conceived that provides great performance, fit, and function. The material composition of the outer layer 20 can be at least one of cotton, organic cotton, silk, nylon, polyester, spandex, viscose, rayon, hemp, linen, wool, merino wool, microfiber acrylics, polypropylene, polytetrafluoroethylene fabric, yarn, or lyocell. Preferably, materials that provide moisture wicking capabilities, temperature regulation, protection against odor, protection against staining and deterioration, and protection against bacteria, fungus and other microorganisms, are helpful in the selection of the material or materials in the outer layer of the present invention.

The cap 10 may also have an inner layer 18. The inner layer 18 may be made from any material naturally occurring or synthetic now known or that may be conceived that provides great performance, fit, and function. The inner layer 18 may be made of any of the materials that may comprise the outer layer 20.

The cap 10 may also have a band 19, which is a separate piece of fabric material is attached to either the inner layer 18 and/or outer layer 20, depending on the construction of the cap 10. The band 19 may also be attached to either side of the inner layer 18 or outer layer 20 or disposed between the inner layer 18 and outer layer 20. The band 19 may be attached by sewing, glue, Velcro®, or any other type of adhesive or attaching means.

The band 19 may be made of any of the materials that may comprise the outer layer 20 or inner layer 18. In addition, the band 19 will have an elastic construction to assist with form and fit on the head H. Examples of materials for the band 19 include elastic, nylon, rubber bands, or any other stretchy material that will create a tight fit.

The cap 10 also includes a means for wrapping hair 30, which is preferably a brush or bristles similar to those on a brush. The means for wrapping hair 30 may be one or more rows of bristles of relatively resilient material to comb through various types of hair without creating knots, yet soft enough to provide comfort. The bristles of the brush'can be made of metal, nylon, stainless steel, boar bristles or any other type of animal hair, fabric, felt, or any other type of brushing material now known or that will be conceived. The means for wrapping hair 30 is of a size, shape and volume to snugly fit within the corresponding shape, size and volume of the cap 10. The means for wrapping hair 30, because of being constructed from resilient material, can be compressed, flattened and otherwise appropriately changed in shape to readily temporarily deform to a shape and size which will fit under the cap 10 to allow for comfortable us use. The means for wrapping hair 30 is also retractable using the handles 12. As is readily apparent from FIG. 2 of the drawings, the means for wrapping hair 30 is of a flexibility that allows for added support to various types of caps 10. The means for wrapping hair 30 can also be in various sizes, e.g., small, medium, and large thicknesses, for use depending on the hair of the wearer. The various sizes of the means for wrapping hair 30 allows the user to customize the cap 10 to their specific needs.

The handles 12 of the cap 10 are used to twist the cap 10 around a wearer's head H once the cap 10 is in place. The handles 12 can be made of wood, metal, plastic, vinyl, rope, string, or any material that may comprise the outer layer 20. The handles 12 can be any shape, including circular, a ring, a hexagon, or square or take on any shape as in a rope loop.

Figure 3:
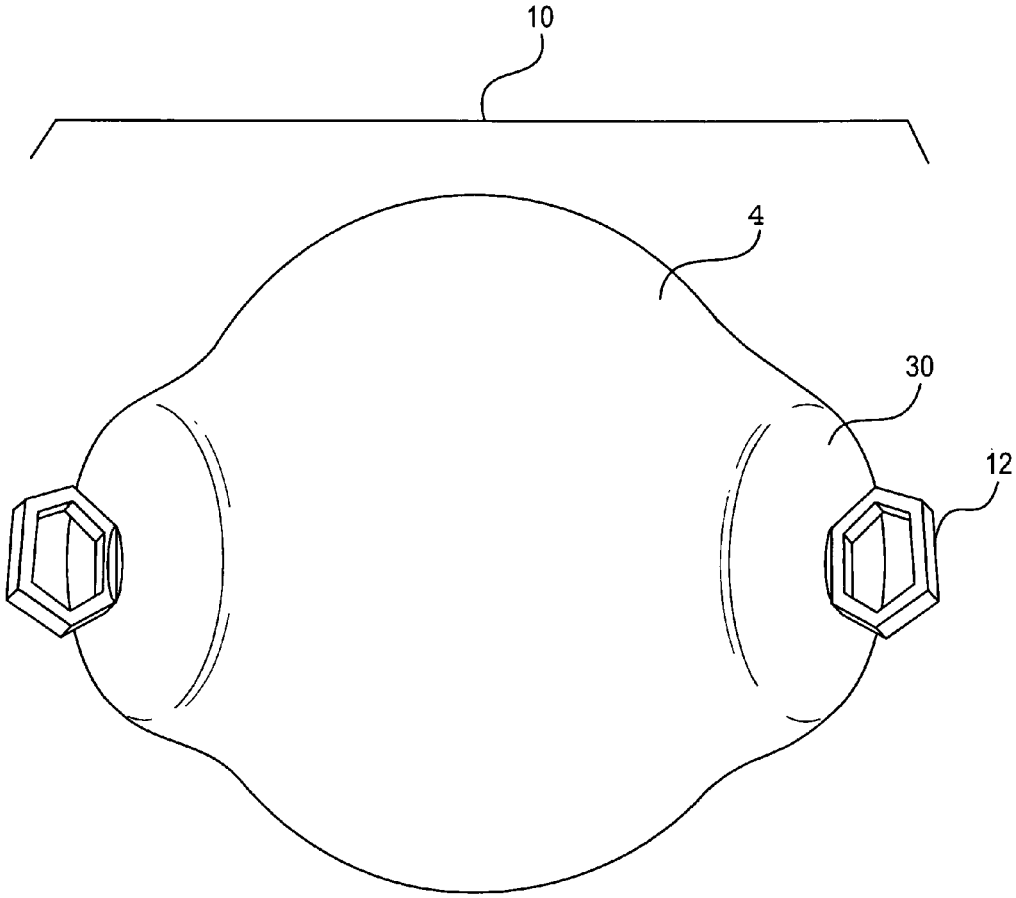
FIG. 3 is a top view of a preferred embodiment of the invention shown pulled over a head.
Figure 4:
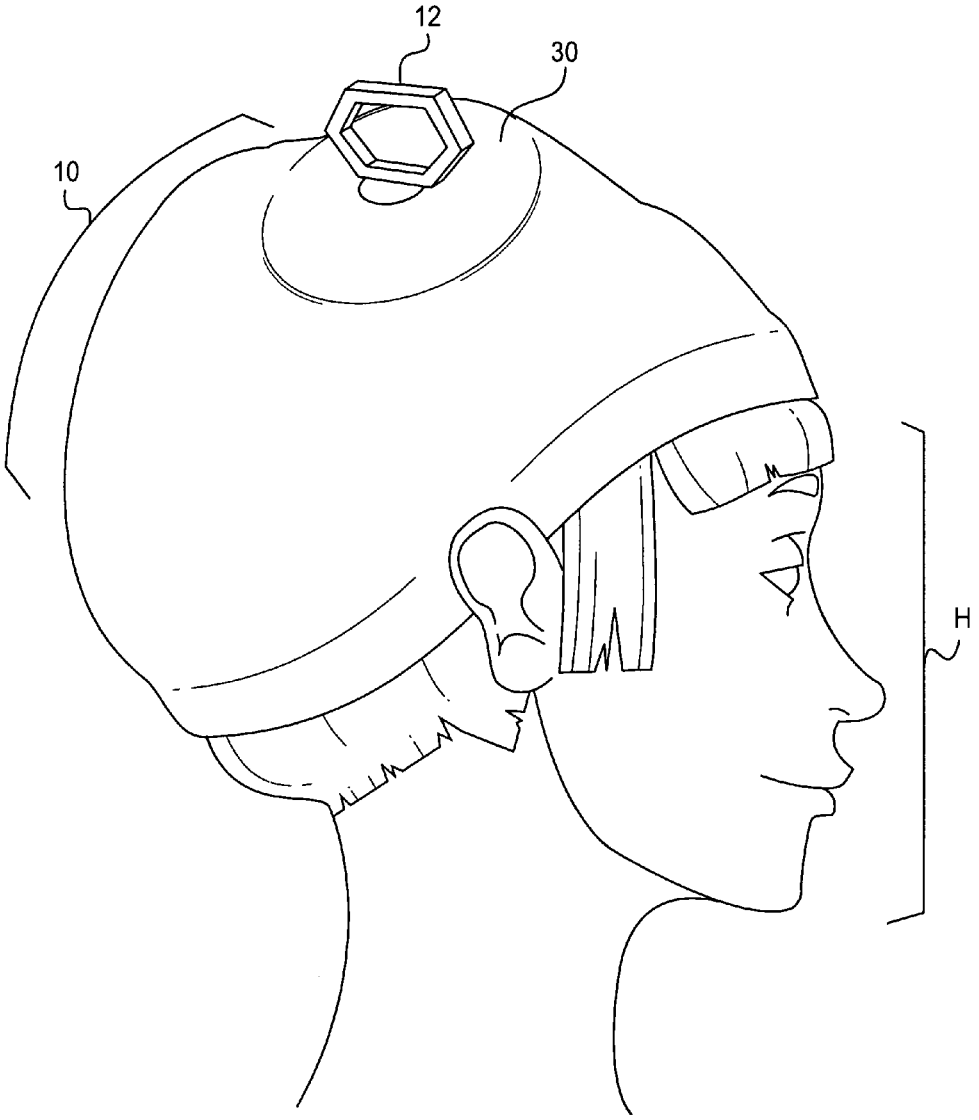
FIG. 4 is a side view of a preferred embodiment of the invention shown pulled over a head during use.

As is apparent from FIG. 3, in use with a person's head H, the cap 10 of the present invention allows a wearer to quickly and efficiently wrap one's hair. Instead of fighting with brushing one's hair and then attempting to place a scarf or other holding means in place or, in the alternative, having to place uncomfortable pins in one's hair to hold the hair in place, a wearer may use the cap 10 of the present invention. The cap 10 is put over a wearer's head H with the means for wrapping hair 30 in its non-retracted position. The hair of the wearer would be in the down position at this stage. The user would then twist the cap 10, using handles 12 in either a clockwise or counter clockwise position. This movement would spin the cap 10 around the head H of the wearer and, simultaneously, brush the hair of the wearer. The hair would begin to fit neatly under the cap 10 as it spins around the head H of a wearer in an organized manner, detangling the hair in the process. Once all the hair has been wrapped, the wearer may retract the means for wrapping hair 30 using the handles 12 and comfortably wear the cap 10 until the wearer chooses to remove the cap 10 and let one's hair down. This wrapping process prevents exposure to the elements such as rain, wind, and snow, as well as from activities such as sleeping and exercise. Once a wearer is ready to let one's hair down, the wearer would simply reverse the process, using the handles to control the means for wrapping hair 30 to brush and un-wrap the hair.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

I claim:

1. A cap comprising:
an outer layer;
a band;
at least one handle; and
means for wrapping hair;
wherein the band is attached to the outer layer in order to secure the cap to the head of a wearer,
wherein the at least one handle is attached to an outer portion of the outer layer of the cap,
wherein the means for wrapping hair is connected to an inner portion of the outer layer and attached through the outer layer to the at least one handle, and
wherein the at least one handle is capable of being used to twist the cap in either a clockwise or counter clockwise direction and to simultaneously wrap the hair of the wearer via the wrapping means.

2. The cap according to claim 1, wherein the means for wrapping hair is at least one selected from the group consisting of a brush and bristles.

3. The cap according to claim 1, wherein the cap is a least one selected from a group consisting of a stocking cap, a casual cap, a sport cap, a dress cap, silk cap, pantyhose cap, and scarf cap.

4. The cap according to claim 1, wherein the means for wrapping hair is attached to the outer layer.

5. The cap according to claim 4, wherein the band is attached to the outer layer and disposed on the inside of the cap.

6. The cap according to claim 1, further comprising an inner layer.

7. The cap according to claim 6, wherein the inner layer is attached to the outer layer and disposed on the inside of the cap.

8. The cap according to claim 1, wherein the at least one handle is selected from the group consisting of wood, metal, plastic, vinyl, rope, and string.

9. A cap comprising:
an outer layer;
an inner layer;
a band;
at least one handle; and
means for wrapping hair;
wherein the band is attached to the outer layer in order to secure the cap to the head of a wearer,
wherein the at least one handle is attached to an outer portion of the outer layer of the cap,
wherein the means for wrapping hair is connected to an inner portion of the outer layer and attached through the outer layer to the at least one handle,
wherein the band is attached to the outer layer and inner layer and disposed between outer layer and the inner layer,
wherein the cap is a least one selected from a group consisting of a stocking cap, a casual cap, a sport cap, a dress cap, silk cap, pantyhose cap, and scarf cap,
wherein the at least one handle is selected from the group consisting of wood, metal, plastic, vinyl, rope, and string, and
wherein the at least one handle is capable of being used to twist the cap in either a clockwise or counter clockwise direction and to simultaneously wrap the hair of the wearer via the wrapping means.

10. A cap comprising:
an outer layer;
at least one handle; and
means for wrapping hair;
wherein the at least one handle is attached to an outer portion of the outer layer of the cap,
wherein the means for wrapping hair is connected to an inner portion of the outer layer and attached through the outer layer to the at least one handle, and
wherein the at least one handle is capable of being used to twist the cap in either a clockwise or counter clockwise direction and to simultaneously wrap the hair of the wearer via the wrapping means.

* * * * *